US007946929B2

(12) United States Patent
Wahlin et al.

(10) Patent No.: US 7,946,929 B2
(45) Date of Patent: May 24, 2011

(54) GOLF CLUB FACE HAVING ENCAPSULATED TUNED STRUCTURE

(75) Inventors: Richard Steven Wahlin, Keller, TX (US); Andrew G. Oldknow, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 135 days.

(21) Appl. No.: 12/402,962

(22) Filed: Mar. 12, 2009

(65) Prior Publication Data

US 2010/0234134 A1 Sep. 16, 2010

(51) Int. Cl.
*A63B 53/04* (2006.01)

(52) U.S. Cl. ..... 473/324; 473/329; 473/342; 473/349

(58) Field of Classification Search ..... 473/324–350, 473/287–292

See application file for complete search history.

(56) References Cited

U.S. PATENT DOCUMENTS

| | | | | | |
|---|---|---|---|---|---|
| 890,836 | A | * | 6/1908 | Beale | 473/329 |
| 3,847,399 | A | * | 11/1974 | Raymont | 473/350 |
| 4,679,792 | A | * | 7/1987 | Straza et al. | 473/329 |
| 5,301,941 | A | * | 4/1994 | Allen | 473/327 |
| 5,316,304 | A | * | 5/1994 | Yost | 473/330 |
| 5,497,993 | A | * | 3/1996 | Shan | 473/329 |
| 5,505,453 | A | | 4/1996 | Mack | |
| 5,807,190 | A | * | 9/1998 | Krumme et al. | 473/342 |
| 5,899,819 | A | * | 5/1999 | Mount et al. | 473/329 |
| 6,007,435 | A | * | 12/1999 | Chern | 473/342 |
| 6,257,999 | B1 | * | 7/2001 | Dahm | 473/563 |
| 6,368,231 | B1 | * | 4/2002 | Chen | 473/329 |
| 6,723,007 | B1 | | 4/2004 | Chao | |
| 6,951,518 | B2 | * | 10/2005 | Solheim et al. | 473/324 |
| 7,192,365 | B2 | * | 3/2007 | Souza et al. | 473/329 |
| 2003/0027659 | A1 | * | 2/2003 | Brown | 473/329 |
| 2003/0228932 | A1 | | 12/2003 | Ehlers et al. | |
| 2005/0075193 | A1 | * | 4/2005 | Otoguro | 473/346 |
| 2010/0248859 | A1 | * | 9/2010 | Kim et al. | 473/329 |

FOREIGN PATENT DOCUMENTS

WO 03037447 A1 5/2003

OTHER PUBLICATIONS

International Search Report for PCT/US2010/024392 mailed May 27, 2010.

* cited by examiner

*Primary Examiner* — Sebastiano Passaniti
(74) *Attorney, Agent, or Firm* — Banner & Witcoff, Ltd.

(57) ABSTRACT

A golf club head has a face portion and a body portion. The face portion has a support frame, a matrix structure attached to and contained within the support frame, and a face material surrounding the matrix structure. In some aspects, the matrix structure may be a racquet structure that is tensioned to influence performance characteristics. The face material may be a metal, polymer, ceramic, or a combination thereof, and may be encapsulated over the matrix structure by suitable techniques such as coating, dipping, or molding processes such as injection molding or metal injection molding (MIM). In some aspects, the face material is lighter than the body portion of the club head, to concentrate mass away from the striking face, e.g., as in cup face technology.

17 Claims, 3 Drawing Sheets

GOLF CLUB FACE HAVING ENCAPSULATED TUNED STRUCTURE

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another, e.g., using handicapped scoring, different tee boxes, in team formats, etc., and still enjoy the golf outing or competition. These factors, together with the increased availability of golf programming on television, e.g., golf tournaments, golf news, golf history, and/or other golf programming, and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel, particularly around the greens; some designed for faster or slower swing speeds; etc. A host of swing and/or teaching aids also is available on the market that promises to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics, e.g., club fitting technology, ball launch angle measurement technology, ball spin rates, etc. Also, individual club head models may include multiple variations, such as variations in the loft angle, lie angle, offset features, weighting characteristics, e.g. draw biased club heads, fade biased club heads, neutrally weighted club heads, etc.

Cup face technology has developed in efforts to maximize the spring-like effect of club faces, using very thin or special beta titanium alloy faces. Titanium heads are typically hollow and constructed from two to as many as six pieces. Most foundries use a separate face plate from the crown, hosel, and sole plate. The faceplate is then welded to the other pieces of the head around the perimeter of the face. The weld is thicker than the areas around it to minimize deflection in the outermost regions of the face while maximizing performance in the center of the face.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention are directed to golf clubs and components thereof, such as golf club heads, and methods for manufacturing the same. In one aspect, a golf club head has a face and a body portion. The face has a support frame, a matrix structure attached to and contained within the support frame, and a face material surrounding the matrix structure. The face material may be encapsulated over the matrix structure using suitable techniques, non-limiting examples of which include coating, dipping, and molding techniques such as injection molding or metal injection molding (MIM).

In some aspects, the face material may be a lighter weight material than that used for the club head body, such that the weight of the club head is concentrated in the body portion, e.g., away from the club face. Thus, the face material may be used as an improvement over current golf clubs employing cup face technology. The face material also may exhibit other improved mechanical properties (e.g., density, hardness, elasticity, wear resistance, etc.) over materials conventionally used in striking faces, and/or may exhibit desirable visual effects such as color and/or translucency. Golf club performance may be further improved by tensioning the matrix structure either uniformly or non-uniformly, e.g., to create a draw or fade bias or otherwise influence ball flight characteristics such as loft.

BRIEF DESCRIPTION OF THE DRAWINGS

A more complete understanding of the present invention and certain advantages thereof may be acquired by referring to the following detailed description in consideration with the accompanying drawings, in which.

The reader is advised that the attached drawings are not necessarily drawn to scale.

DETAILED DESCRIPTION

In the following description of various example structures, reference is made to the accompanying drawings, which form a part hereof, and in which are shown by way of illustration various example golf club structures. Additionally, it is to be understood that other specific arrangements of parts and structures may be utilized and structural and functional modifications may be made without departing from the scope of the present invention. Also, while terms such as "top," "bottom," "front," "back," "rear," "side," "underside," "overhead," and the like may be used in this specification to describe various example features and elements of the invention, these terms are used herein as a matter of convenience, e.g. based on the example orientations shown in the figures and/or the orientations in typical use. Nothing in this specification should be construed as requiring a specific three dimensional or spatial orientation of structures.

A. General Description of Golf Clubs and Club Heads

Figure 1:
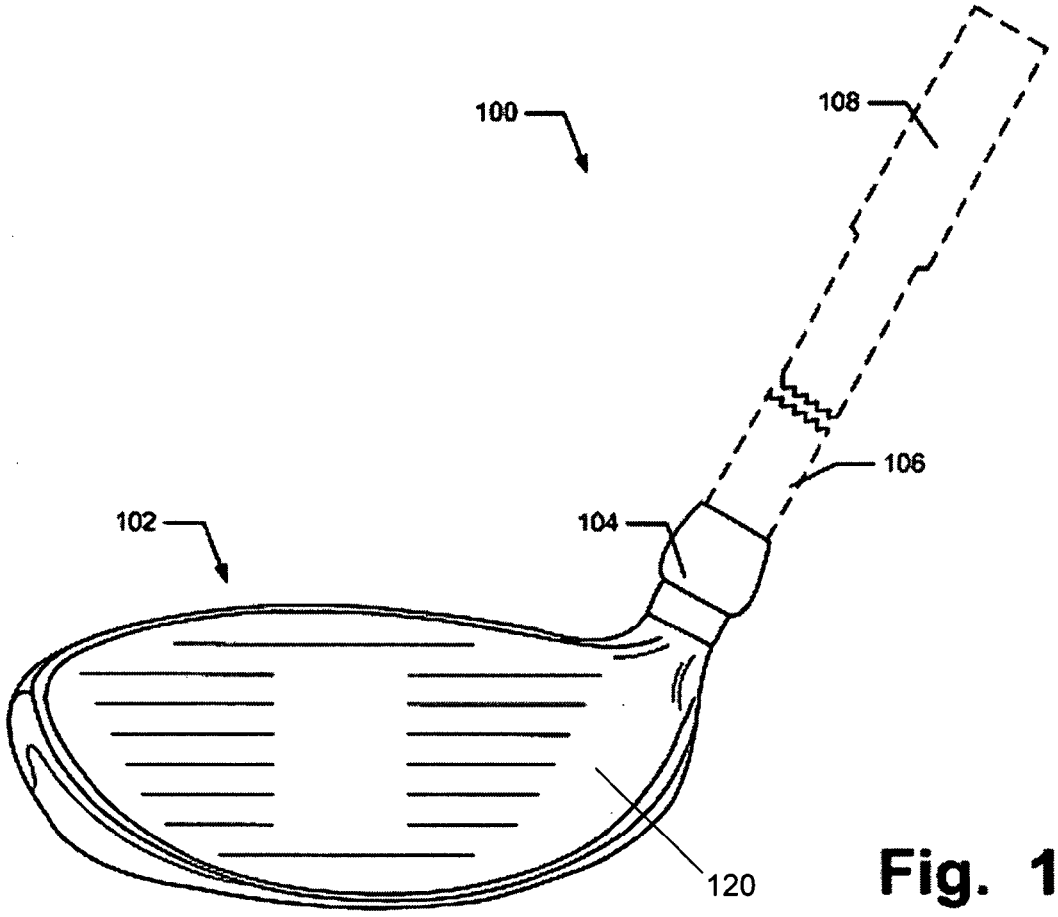
FIG. 1 illustrates an example of a golf club.

FIG. 1 generally illustrates an example golf club 100. This club 100 includes a club head 102, a releasable club head/ shaft connection region 104 that connects the club head to a shaft 106, and a grip member 108 engaged with the shaft 106. While a driver/wood-type golf club head 102 is illustrated in FIG. 1, aspects of this invention may be applied to any type of club head, e.g., fairway wood club heads, iron type golf club heads of any desired loft, e.g., from a 0-iron or 1-iron to a wedge, wood or iron type hybrid golf club heads, putter heads, and the like. The body portion of the club head 102 may be made from conventional materials, in conventional constructions, and in conventional manners as are known and used in the art. Details of the face portion of the club head 102 will be discussed below.

Any desired materials may be used for the shaft member 106, including conventional materials that are known and used in the art, such as steel, graphite, polymers, composite materials, combinations of these materials, etc. The grip member 108 may be engaged with the shaft 106 in any desired manner, including in conventional manners that are known and used in the art, e.g. via cements or adhesives, via mechanical connections, etc. Any desired materials may be used for the grip member 108, including conventional materials that are known and used in the art, such as rubber, polymeric materials, cork, rubber or polymeric materials with cord or other fabric elements embedded therein, cloth or fabric, tape, etc. Optionally, if desired, the grip member 108 may be releasably connected to the shaft 106 using a releasable connection.

B. General Description of Club Head and Face Portion

The club head has a body portion 102 and a face portion 120. In some examples, the face portion 120 and body portion are separately fabricated, and then secured together using any suitable technique such as adhesive bonding, welding, or the like. Alternatively, one or more components of the face portion 120, such as the support frame 122 and/or matrix structure 124, may be integrally constructed with the body portion 102.

The face portion 120 may comprise the entire striking face of the club head 102, as illustrated in FIG. 1. Alternatively, the face portion 120 may comprise less than the entire striking face of the club head 120, e.g., only the areas of the striking face where ball contact normally occurs. Usually the face portion 120 comprises at least about 60%, and often at least about 75%, of the surface area of the striking face, although it is contemplated in some instances that the face portion 120 may occupy a smaller fraction of the surface area of the striking face.

Figure 2:
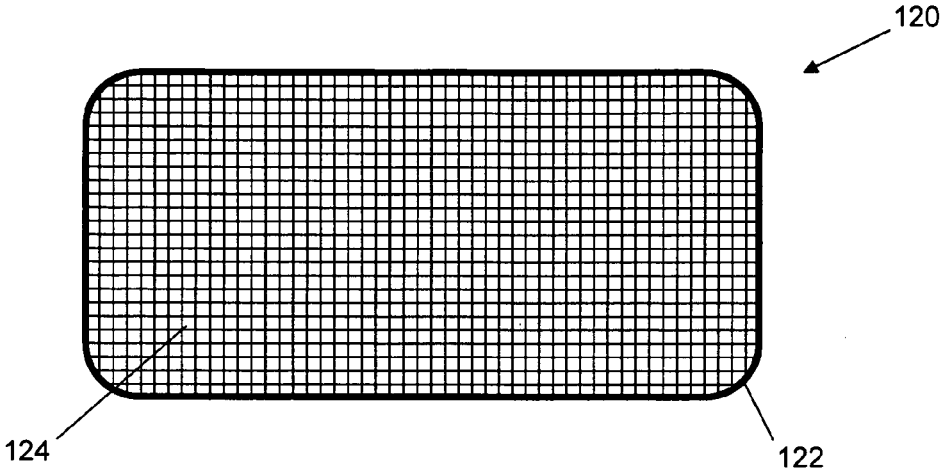
FIG. 2 schematically illustrates a face portion having a support frame and a matrix structure.
Figure 3:
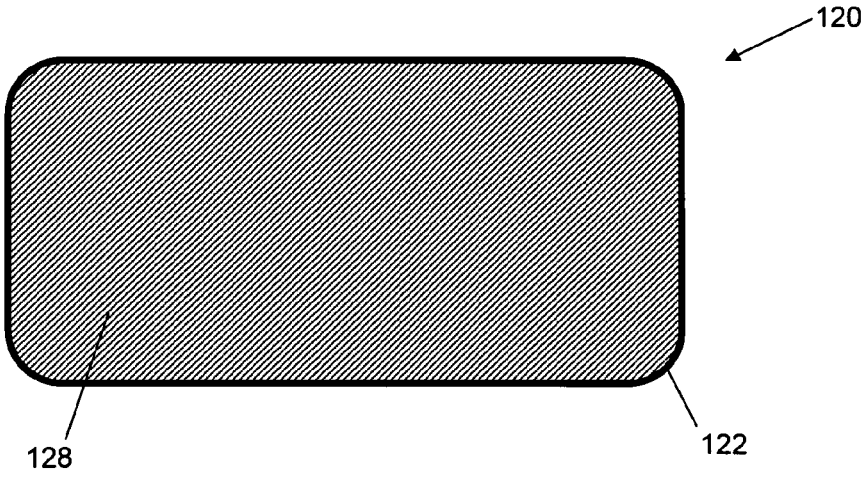
FIG. 3 schematically illustrates the face portion of FIG. 2 following encapsulation of the matrix structure with a face material.

As illustrated in FIGS. 2 and 3, the face portion 120 may be generally rectangular. A rectangular face portion 120 may be used in combination with club heads having striking faces that have either rectangular or non-rectangular shapes. The shape of the face portion 120 may be selected to correspond to the shape of the striking face, or different face portion and striking face shapes may be combined to achieve desired visual effects and/or performance characteristics.

In some examples and as illustrated in FIGS. 2 and 3, the face portion 120 has a support frame 122 and a matrix structure 124 attached to the support frame. The support frame 122 may be constructed of any suitable material, such as metals including those conventionally used in club heads, polymeric materials, ceramics, composites, and the like. In general, the material selected for the support frame 122 should be suitable for attachment to the body portion and for support of the matrix structure 124 and face material 128 as discussed below.

The matrix structure 124 is generally porous, so that a face material may be injected or otherwise formed over the matrix structure 124 to form an interleaved configuration as described more fully below. In some examples, the matrix structure 124 may be in the form of a "racquet" comprising a plurality of cables or wires formed as a mesh or screen, with individual cables or wires attached to opposite or adjacent sides (or areas) of the support frame 122. The matrix structure may be constructed of any suitable material, including metals such as steel, polymeric materials including polyesters, polyamides such as nylon, or the like. The dimensions of the wires depend on such factors as the composition and thickness of the face material. By way of example, the gauge (thickness) of the wires may range from about 0.5 to about 3 mm, more usually from about 1 to about 2.5 mm.

In some aspects, the matrix structure 124 may be tensioned, such as to influence performance characteristics of the club head. For example, wires may be tensioned uniformly throughout the matrix structure 124, e.g., to create a large "sweet spot" on the striking face that may help improve a golfer's consistency. Alternatively, wires may be tensioned non-uniformly to achieve desired effects, such as creating a denser region in the center of the striking face, or creating a draw or fade bias or otherwise influencing loft or other ball flight characteristics.

With reference to FIG. 3, a face material 128 may be encapsulated over the support matrix structure 124. The face material may be any of a variety of materials, such as metals, polymers, ceramics, metal/polymer composites, and the like. The face material 128 may be encapsulated over the matrix structure 124 by any suitable process such as coating, dipping, injection molding, metal injection molding, and the like. Usually, the face material 128 is provided in a molten or otherwise formable state to enable the material to interleave with the matrix structure 124.

The face material 128 may be (but is not necessarily) a material of lighter weight than the material used for the body portion 102. This way, the mass (e.g., center of gravity) of the club head can be concentrated away from the striking face, e.g., as in golf clubs employing cup face technology. The face material 128 also may be selected to exhibit other improved mechanical properties for the striking face, e.g., hardness, density, elasticity, wear resistance, etc. The face material 128 also may be selected to create visual effects such as color, translucency/transparency, or the like. In some examples, a translucent face material 128 may enable the matrix structure 124 to be seen through the striking face of the finished golf club head 102 to create interesting visual effects. The thickness of the face material depends on such factors as the material(s) used for construction, and often ranges from about 1 to about 4 mm. The density of the face material may vary over a wide range but often ranges from about 1 to about 8 $g/cm^3$.

C. Specific Examples of the Invention

In the example shown in FIG. 2, a face portion 120 may be prepared by providing a metal support frame 122 having wires 124 whose ends are affixed to opposite inside surfaces of the support frame 122 using any suitable technique, such as welding, to form a racquet. The wires may be tensioned (or "tuned") to create a surface of uniform density and tension for the striking face. The wires 124 may be then encapsulated with a metal/polymer composite material to form a face material 128 as illustrated in FIG. 3.

In one aspect, the face material may be applied over the matrix structure 124 by metal injection molding (MIM). In general, MIM combines the technologies of thermoplastic injection molding and powder metallurgy, and has been used to produce complex-shaped, high density, and high performance metal parts. Tolerances as small as +/−0.003" per linear inch often can be achieved even without the need for secondary processes.

Figure 4:
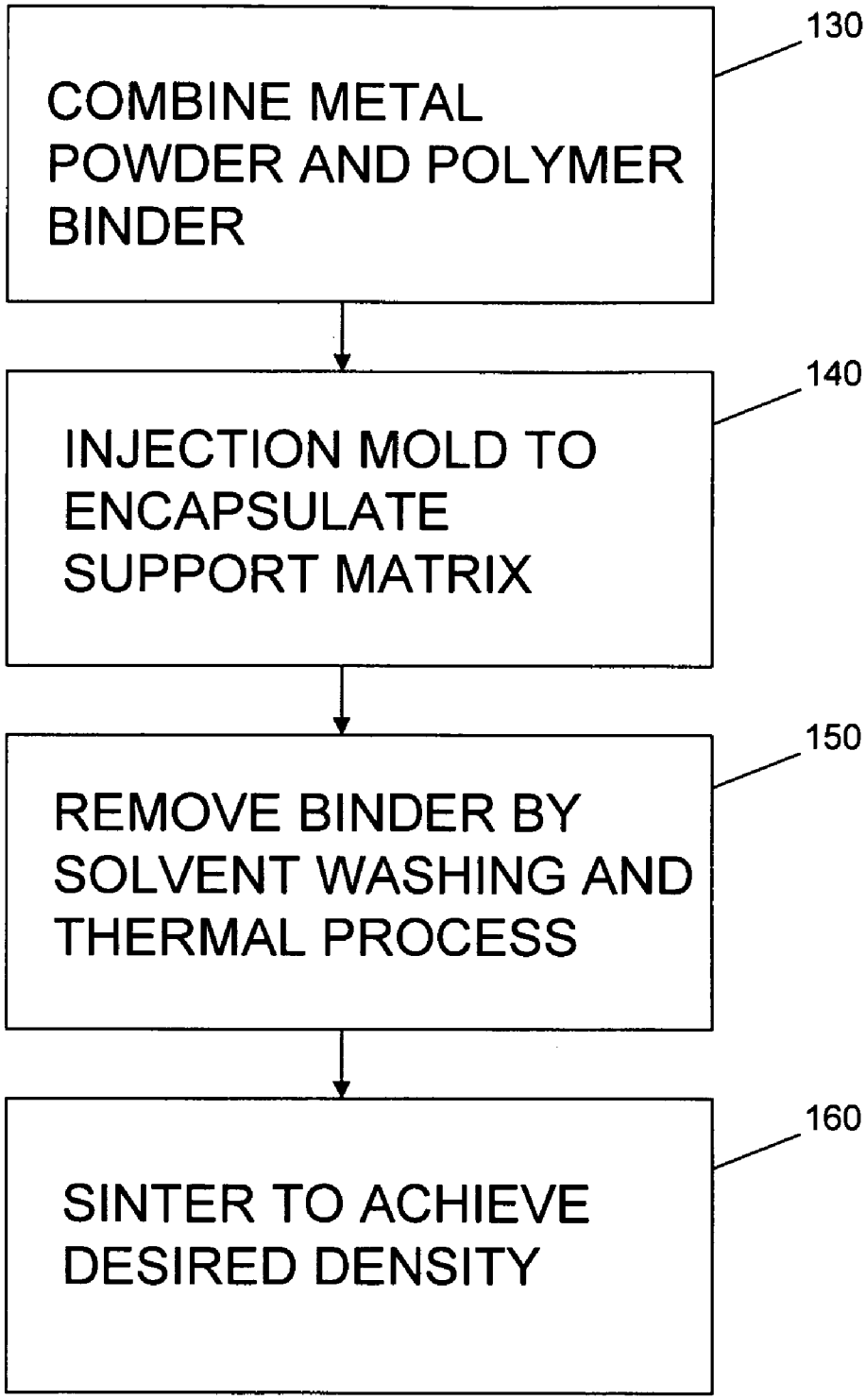
FIG. 4 is an example of a flow diagram for encapsulating a face portion by metal injection molding.

As illustrated in the flow diagram of FIG. 4, the MIM process involves a step 130 of mixing fine metal powders and a polymer. Optionally, alloying additives also may be added to the mixture. The polymer acts as a binder to allow the metal to be injected into a mold using equipment similar to standard plastic injection molding machines. Next, the support frame 122 containing the matrix structure 124 may be placed into a mold, and the matrix structure 124 may be encapsulated with the face material 128 by a step of injection molding 140.

In the following step 150, the polymer binder(s) is removed by solvent washing and thermal processing. Following removal of the binder(s), the component is sintered 160 at a sufficiently high temperature to bind the particles without melting the metal. The sintering time and temperature may be selected to achieve a desired density. The resulting face portion 120 may be then bonded to a club head body portion to form a club head 102, as illustrated in FIG. 1.

In other examples, the face material may comprise a combination of materials. For example, a metal/polymer composite may be encapsulated over a "tuned" matrix structure to create a striking face that is strong, lightweight, and translucent or semi-translucent, offering both superior performance characteristics and desirable visual effects. Other components, such as colorants, anti-corrosive agents, and the like, also may be added to the face material to improve functional and/or aesthetic properties.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club head comprising a face portion and a body portion, wherein the face portion comprises a support frame, a matrix structure comprising a plurality of tensioned wires attached to inside surfaces of the support frame, the inside surfaces of the support frame adapted to maintain predetermined tension on the plurality of wires, and a face material encapsulating the plurality of wires and surrounding the matrix structure, wherein the face material has a density lower than that of the body portion.

2. The golf club head of claim 1, wherein the wires are tensioned uniformly throughout the matrix structure.

3. The golf club head of claim 1, wherein the wires are tensioned non-uniformly in the matrix structure.

4. The golf club head of claim 1, wherein the face material is selected from the group consisting of metals, polymers, ceramics, and combinations thereof.

5. The golf club head of claim 4, wherein the face material is translucent.

6. The golf club head of claim 1, wherein the support frame is integral with the body portion.

7. The golf club head of claim 1, wherein the matrix structure is integral with the support frame.

8. A golf club comprising a shaft and the golf club head of claim 1.

9. A method of manufacturing a golf club head having a face portion and a body portion, the method comprising:

providing a support frame;

attaching a matrix structure comprising a plurality of wires to inside surfaces of the support frame;

tensioning the wires, wherein the inside surfaces of the support frame are adapted to maintain predetermined tension on the plurality of wires;

encapsulating the plurality of wires with a face material over the matrix structure; and solidifying the face material to surround the matrix structure, wherein the face material has a density lower than that of the body portion.

10. The method of claim 9, wherein the wires are tensioned uniformly throughout the matrix structure.

11. The method of claim 9, wherein the wires are tensioned non-uniformly in the matrix structure.

12. The method of claim 9, wherein the face material is selected from the group consisting of metals, polymers, ceramics, and combinations thereof.

13. The method of claim 12, wherein the face material is encapsulated over the support matrix by at least one of coating, dipping, and injection molding.

14. The method of claim 12, wherein the face material is translucent.

15. The method of claim 9, wherein the face material is encapsulated over the support matrix by metal injection molding.

16. The method of claim 9, further comprising attaching the face portion to a body portion to form a golf club head.

17. The method of claim 16, further comprising attaching the golf club head to a shaft to form a golf club.

* * * * *